US009839239B2

(12) United States Patent
Wu

(10) Patent No.: US 9,839,239 B2
(45) **Date of Patent: *Dec. 12, 2017**

(54) ELECTRONIC CIGARETTE AND ELECTRONIC CIGARETTE ATOMIZING DEVICE

(71) Applicant: SHENZHEN SMACO TECHNOLOGY LIMITED, Shenzhen, Guangdong Province (CN)

(72) Inventor: Yangyang Wu, Shenzhen (CN)

(73) Assignee: SHENZHEN SMACO TECHNOLOGY LIMITED, Shenzhen, Guangdong Province (CN)

( * ) Notice: Subject to any disclaimer, the term of this patent is extended or adjusted under 35 U.S.C. 154(b) by 400 days.

This patent is subject to a terminal disclaimer.

(21) Appl. No.: 14/583,740

(22) Filed: Dec. 28, 2014

(65) Prior Publication Data

US 2016/0095354 A1 Apr. 7, 2016

(30) Foreign Application Priority Data

Sep. 5, 2014 (CN) ..... 2014 2 0509037 U

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

| | | | | |
|---|---|---|---|---|
| 9,498,001 | B2 * | 11/2016 | Wu | A24F 47/008 |
| 2015/0090280 | A1 * | 4/2015 | Chen | A24F 47/008 131/329 |
| 2015/0208725 | A1 * | 7/2015 | Tsai | H05B 1/0244 392/390 |
| 2017/0027221 | A1 * | 2/2017 | Liu | H02J 7/0044 |

* cited by examiner

*Primary Examiner* — Michael H Wilson
*Assistant Examiner* — Katherine Will
(74) *Attorney, Agent, or Firm* — Cheng-Ju Chiang

(57) ABSTRACT

The present invention discloses an electronic cigarette and an electronic cigarette atomizing device. The electronic cigarette atomizing device comprises an atomizing component installed within an outer tube of the atomizing device and used for heating and atomizing tobacco liquid, and a liquid cup used for accommodating tobacco liquid. The present invention is characterized that the atomizing component comprises an atomizing holder and a heating component fixed inside the atomizing holder. A filter component is installed for filtering tobacco liquid to enter the atomizing holder and is disposed between the liquid cup and the atomizing holder. The filter component comprises a filter net with micropores and a filter cotton. The atomizing device of the present invention can be used to filter tobacco liquid to make produced tobacco smokes therefrom being pure and clean, and can effectively prevent heat from being conducted to users' mouths to cause burns or scald problems.

19 Claims, 3 Drawing Sheets

ELECTRONIC CIGARETTE AND ELECTRONIC CIGARETTE ATOMIZING DEVICE

BACKGROUND OF THE INVENTION

1. Field of the Invention

The present invention relates to electronic technology fields, particularly with regard to an electronic cigarette and an electronic cigarette atomizing device.

2. the Related Arts

The air passage of the existing electronic cigarette atomizing device is usually only one. The heated tobacco liquid evaporates to form smoke, which will condense into a liquid in the air passage after cooling. Users tend to easily inhale condensates and a feeling of discomfort is caused thereby. Secondly, materials of an outer tube of the electronic cigarette atomizing device are mostly metal material, and tend to conduct heat to burn or scald users' mouths when smoking. In addition, the tobacco liquid in the atomizing device directly contacts with a heating device. When a use angle varies, such design will result in disobedience of the guided tobacco liquid and cause some burnt smell problems.

SUMMARY OF THE INVENTION

The main objective of the present invention is to provide an electronic cigarette and an electronic cigarette atomizing device. The present invention is able to fully meet needs of users. Meanwhile the present invention is able to avoid burnt smell problems generated due to disobedience of guided tobacco liquid and in the meantime to increase better experience of users of the electronic cigarette.

To achieve the objective of the present invention mentioned above, the present invention adopts technology solutions as follows. An electronic cigarette atomizing device comprises an atomizing component installed within an outer tube of the atomizing device and used for heating and atomizing tobacco liquid, and a liquid cup used for accommodating tobacco liquid. The atomizing component comprises an atomizing holder and a heating component fixed inside the atomizing holder. A filter component is installed and used for filtering tobacco liquid to enter the atomizing holder, and is disposed between the liquid cup and the atomizing holder. The other end of the atomizing holder is connected in turn to an engaging insert and a thread thimble. The filter component comprises a filter net with micropores and a filter cotton, and the filter cotton is attached to a bottom of the filter net. Two sets of air passages are formed and disposed between the liquid cup and the outer tube, and the air passages are communicated with the atomizing component.

Further, a concave first groove is disposed and installed at each of both sides of the liquid cup, and at least one of the air passages is formed by the first groove and an inner wall of the outer tube.

Further, the filter net is an annular filter net. A projecting annular wall flange is formed at side edges of each of upper and lower ends of the filter net, and a second groove matching a size of the first groove is installed and disposed on the wall flanges.

Further, a metal sleeve is installed and disposed between the atomizing holder and the outer tube. A lower end of the metal sleeve completely surrounds the atomizing holder, and an upper end of the metal sleeve surrounds a lower end portion of the liquid cup.

Further, a through groove is disposed and installed in a middle end portion of the atomizing holder. An assembly hole is installed and disposed at one end portion of the through groove and used for assembling the heating component, and is symmetrically arranged at both sides thereof. The heating component is attached to fit the filter cotton.

Further, an air via hole is installed and disposed in a middle portion of the metal engaging insert, and air is introduced through the air via hole from an outside to an inside of the atomizing device. An insulating pad is installed between the thread thimble and the engaging insert.

Further, the outer tube is a plastic outer tube.

Further, a top of the outer tube further comprises a top cover, and the top cover comprises a vent hole disposed therein. The vent hole is communicated with the air passages of the liquid cup.

An electronic cigarette is also provided wherein the electronic cigarette atomizing device mentioned above is adopted therein. The electronic cigarette further comprises a battery component connected to the electronic cigarette atomizing device. The battery component comprises batteries, control panels, pneumatic switches and indication lights.

Further, a lower portion of the atomizing holder connects to the thread thimble which electrically connects to a positive electrode of the battery component of the electronic cigarette, and a negative electrode of the battery component of the electronic cigarette electrically connects to the metal engaging insert.

The beneficial effect of the present invention is that a groove shape air passage is installed and disposed at each of both sides of the liquid cup. Smokes can be led to the outside via the air passage, and phenomenon of condensation can be thereby reduced and users are prevented from sucking condensate into their mouths. The filter component is installed at the bottom of the liquid cup and is used for filtering tobacco liquid to move the filtered tobacco liquid into the atomizing holder, and the filter component can filter tobacco liquid to keep produced smokes from the filtered tobacco liquid being pure and clean. The metal sleeve is installed between the atomizing holder and the outer tube, and the metal sleeve wholly surrounds the atomizing holder and only partially surrounds the liquid cup. Since the outer tube is made of plastic material, the metal sleeve can be used to isolate heat to avoid deformation of the outer tube. Besides the metal sleeve does not extend to cover an upper end of the outer tube so that heat can be effectively prevented from being conducted to users' mouths and causing burns or scald problems. The filter cotton has a liquid storage function to avoid burnt smell problems due to disobedience of the guided tobacco liquid caused by varying of use angles of the electronic cigarette atomizing device.

DETAILED DESCRIPTION OF PREFERRED EMBODIMENT

In order to facilitate understanding of the present invention, the following descriptions accompanying attached drawings are presented to further completely describe the present invention. Attached drawings show a preferred embodiment of the present invention. However, the present invention may be implemented by many different forms thereof and is not limited to the preferred embodiments described herein. On the contrary, the purpose of providing these embodiments is for much more thorough and entire understanding of the published disclosure of the present invention.

Figure 1:
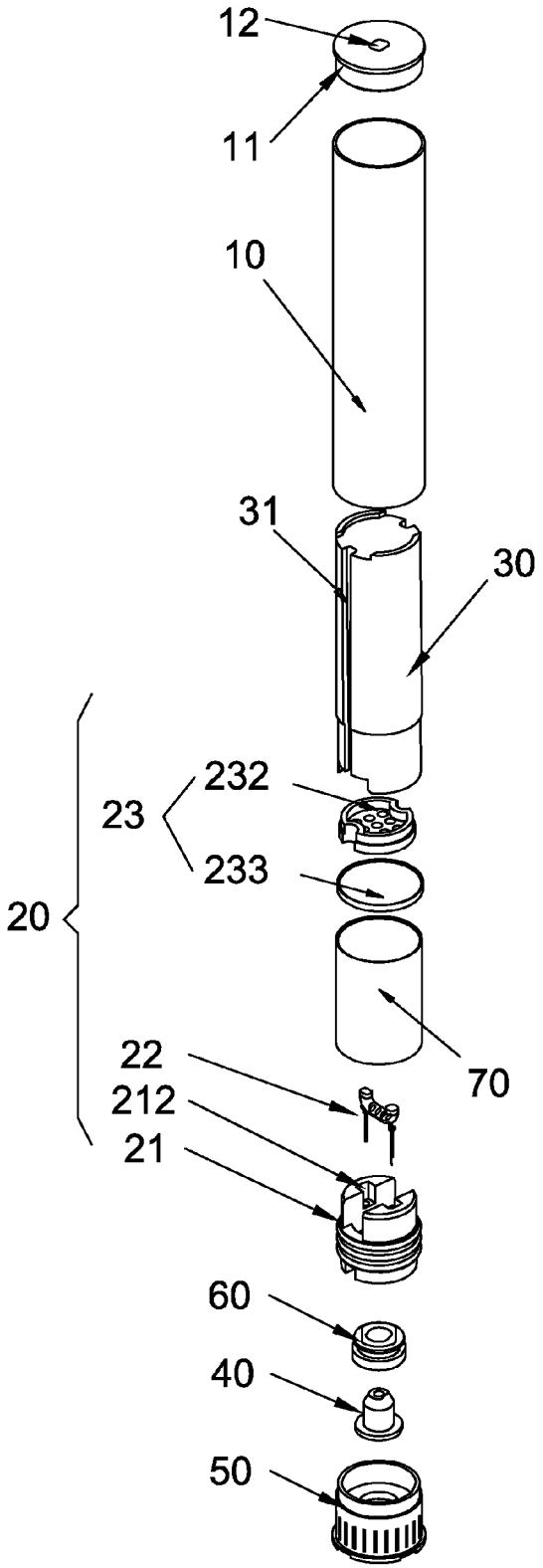
FIG. 1 shows a structural schematic exploded perspective view of an electronic cigarette atomizing device in accordance with the present invention.
Figure 2:
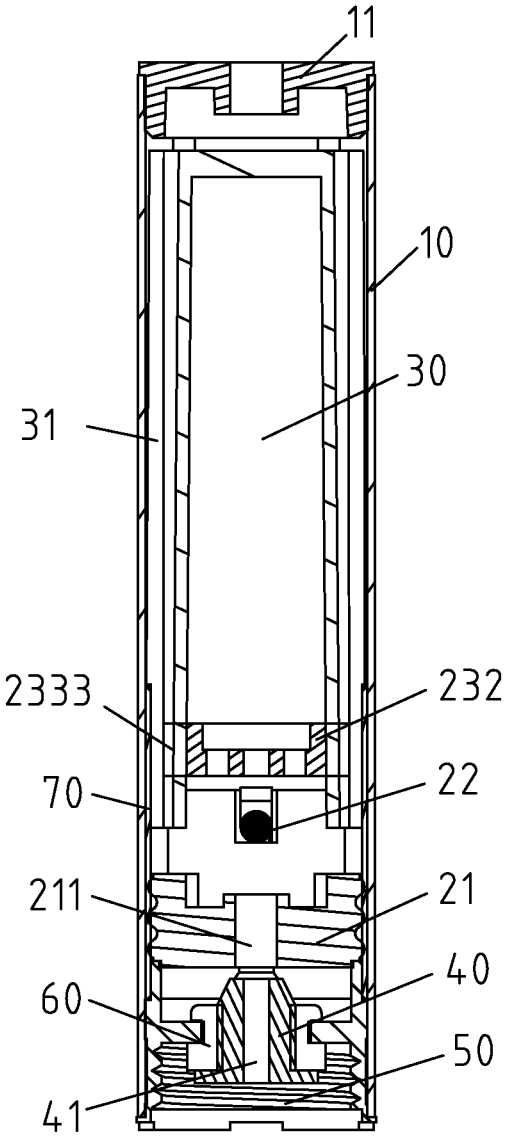
FIG. 2 shows a schematic cross sectional view of the assembled electronic cigarette atomizing device of FIG. 1 in accordance with the present invention.
Figure 3:
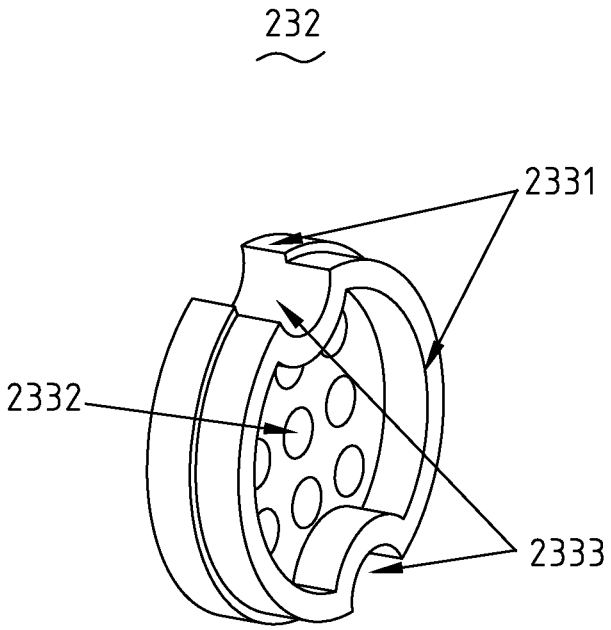
FIG. 3 shows a structural schematic perspective view of a filter net in accordance with the present invention.

With reference to FIGS. 1 to 3, they show structural schematic views of an electronic cigarette atomizing device in accordance with an embodiment of the present invention.

An electronic cigarette atomizing device in accordance with the present invention comprises an atomizing component 20 installed within an outer tube 10 for heating and atomizing tobacco liquid and a liquid cup 30 for accommodating tobacco liquid. The outer tube 10 is made of plastic material, and is used to provide a very good heat insulation effect to avoid burn or scald hands or mouths of users when using the electronic cigarette. A top of the outer tube 10 further comprises a top cover 11, and the top cover 11 comprises a vent hole 12 disposed therein. First grooves 31 to be inwardly concave are respectively disposed at both sides of the liquid cup 30. The atomizing component 20 comprises an atomizing holder 21 and a heating component 22 fixed inside the atomizing holder 21. A filter component 23 is installed for filtering tobacco liquid to enter the atomizing holder 21 and is disposed between the liquid cup 30 and the atomizing holder 21. The other end of the atomizing holder 21 is connected in turn to an engaging insert 40 and a thread thimble 50. The engaging insert 40, the atomizing component 20 and the liquid cup 30 can be assembled from bottom to top within the outer tube 10. The filter component 23 comprises a filter net 232 with micropores 2332 and a filter cotton 233. The filter cotton 233 is attached to a bottom of the filter net 232. The filter net 232 is an annular filter net 232 and a projecting annular wall flange 2331 is formed at side edges of each of upper and lower ends of the filter net 232. The wall flange 2331 is set to be capable of storing a certain amount of tobacco liquid therein, and to separate the micropores 2332 from the filter cotton 233 for a certain distance in order for facilitating the atomizing process of the heating component 22. A second groove 2333 matching a size of the first groove 31 is installed and disposed on the wall flanges 2331, and the first groove 31 and the second groove 2333 are assembled to be aligned. An air passage is formed by the above mentioned two grooves 31, 2333 together with an inner wall of the outer tube 10 when they are matched. An upper end of the air passage is communicated with the vent hole 12, and a lower end of the air passage is communicated with the filter cotton 233. The tobacco liquid from an inside of the liquid cup 30 is filtered through the filter net 232 and then permeates into the filter cotton 233. The heating component 22 atomizes tobacco liquid inside the filter cotton 233, and the atomized tobacco liquid is output to the vent hole 12 through the air passage.

In addition, a through groove 211 is disposed and installed in a middle end portion of the atomizing holder 21. An assembly hole 212 is installed and disposed at one end portion of the through groove 211 for assembling the heating component 22 and is symmetrically arranged at two sides thereof. The heating component 22 is inserted into and fixed to the assembly hole 212. A work area of the heating component 22 is engaged with and fitted to the filter cotton 233. A metal sleeve 70 is installed and disposed between the atomizing holder 21 and the outer tube 10. A lower end of the metal sleeve 70 completely surrounds the atomizing holder 21, and an upper end of the metal sleeve 70 surrounds a lower end portion of the liquid cup 30. The atomizing holder 21 and the liquid cup 30 can be fixed through the metal sleeve 70. An air via hole 41 is installed and disposed in a middle portion of the metal engaging insert 40, and air is introduced through the air via hole 41 from an outside to an inside of the atomizing device after assembly. An insulating pad 60 is installed between the thread thimble 50 and the engaging insert 40 to avoid contacts between the engaging insert 40 and the thread thimble 50 while the contacts may lead to a short circuit situation.

An electronic cigarette is also provided to comprise the electronic cigarette atomizing device mentioned above. The electronic cigarette further comprises a battery component connected to the electronic cigarette atomizing device. The battery component comprises batteries, control panels, pneumatic switches and indication lights. A lower portion of the atomizing holder 21 connects to the thread thimble 50. The thread thimble 50 electrically connects to a positive electrode of the battery component of the electronic cigarette, and a negative electrode of the battery component of the electronic cigarette electrically connects to the metal engaging insert 40.

The beneficial effect of the present invention is that a groove shape air passage 31, 2333 is installed and disposed at each of both sides of the liquid cup 30. Smokes can be led to the outside via the air passage 31, 2333, and phenomenon of condensation can be thereby reduced and users are prevented from sucking condensate into their mouths. The filter component 23 is installed at the bottom of the liquid cup 30 and is used for filtering tobacco liquid to move the filtered tobacco liquid into the atomizing holder 21, and the filter component 23 can filter tobacco liquid to keep produced smokes from the filtered tobacco liquid being pure and clean. The metal sleeve 70 is installed between the atomizing holder 21 and the outer tube 10, and the metal sleeve 70 wholly surrounds the atomizing holder 21 and only partially surrounds the liquid cup 30. Since the outer tube 10 is made of plastic material, the metal sleeve 70 can be used to isolate heat to avoid deformation of the outer tube 10. Besides, the metal sleeve 70 does not extend to cover an upper end of the outer tube 10 so that heat can be effectively prevented from being conducted to users' mouths and causing burns or scald problems. The filter cotton 233 has a liquid storage function to avoid burnt smell problems due to disobedience of the guided tobacco liquid caused by varying of use angles of the electronic cigarette atomizing device.

Descriptions and applications of the present invention are intended to be illustrative, not intended to limit the scope of the present invention to the above described embodiment. Variations and modifications of the embodiment disclosed herein are possible, and for those of ordinary skilled in the field, alternative and equivalent various components of the embodiment are common senses and well known. Where any person skilled in this art should know that the present invention can be achieved in other forms, structures, arrangements, proportions, and with other components, materials, and parts, the changes or improvements are still covered within the inventive spirit of the present invention and the scope as defined in the following claims. Without departing from the spirit and scope of the present invention, people can make other modifications and changes of the embodiment disclosed herein.

What is claimed is:

1. An electronic cigarette atomizing device, comprising an atomizing component installed within an outer tube of the atomizing device and used for heating and atomizing tobacco liquid, and a liquid cup used for accommodating tobacco liquid, wherein the atomizing component comprises an atomizing holder and a heating component fixed inside the atomizing holder, a filter component is installed for filtering tobacco liquid in order to enter an inside of the atomizing holder and is disposed between the liquid cup and the atomizing holder, the other end of the atomizing holder is connected in turn to an engaging insert and a thread thimble, the filter component comprises a filter net with micropores and a filter cotton, the filter cotton is attached to a bottom of the filter net, two air passages are formed and disposed between the liquid cup and the outer tube, and the air passages are communicated with the atomizing component;

wherein a through groove is disposed and installed in a middle portion of the atomizing holder, an assembly hole is installed and disposed at one end portion of the through groove for assembling the heating component, and is symmetrically arranged at both sides thereof, the heating component is attached to the filter cotton.

2. The electronic cigarette atomizing device as claimed in claim 1, wherein a concave first groove is disposed and installed at each of both sides of the liquid cup, and at least one of the air passages is formed by one of the first grooves and an inner wall of the outer tube.

3. The electronic cigarette atomizing device as claimed in claim 2, wherein the filter net is an annular filter net, a projecting annular wall flange is formed at side edges of each of upper and lower ends of the filter net, and a second groove matching a size of the first groove is installed and disposed on the wall flanges.

4. The electronic cigarette atomizing device as claimed in claim 1, wherein a metal sleeve is installed and disposed between the atomizing holder and the outer tube, a lower end of the metal sleeve completely surrounds the atomizing holder, and an upper end of the metal sleeve surrounds a lower end portion of the liquid cup.

5. The electronic cigarette atomizing device as claimed in claim 1, wherein an air via hole is installed and disposed in a middle portion of the engaging insert, and air is introduced through the air via hole from an outside to an inside of the atomizing device, an insulating pad is installed between the thread thimble and the engaging insert.

6. The electronic cigarette atomizing device as claimed in claim 1, wherein the outer tube is a plastic outer tube.

7. The electronic cigarette atomizing device as claimed in claim 1, wherein a top of the outer tube further comprises a top cover, and the top cover comprises a vent hole disposed therein, the vent hole is communicated with the air passages of the liquid cup.

8. An electronic cigarette, wherein the electronic cigarette adopts the electronic cigarette atomizing device as claimed in claim 1, the electronic cigarette further comprises a battery component connected to the electronic cigarette atomizing device, and the battery component comprises batteries, control panels, pneumatic switches and indication lights.

9. The electronic cigarette as claimed in claim 8, wherein a lower portion of the atomizing holder connects to the thread thimble which electrically connects to a positive electrode of the battery component of the electronic cigarette, and a negative electrode of the battery component of the electronic cigarette electrically connects to the engaging insert.

10. An electronic cigarette, wherein the electronic cigarette adopts the electronic cigarette atomizing device as claimed in claim 2, the electronic cigarette further comprises a battery component connected to the electronic cigarette atomizing device, and the battery component comprises batteries, control panels, pneumatic switches and indication lights.

11. An electronic cigarette, wherein the electronic cigarette adopts the electronic cigarette atomizing device as claimed in claim 3, the electronic cigarette further comprises a battery component connected to the electronic cigarette atomizing device, and the battery component comprises batteries, control panels, pneumatic switches and indication lights.

12. An electronic cigarette, wherein the electronic cigarette adopts the electronic cigarette atomizing device as claimed in claim 4, the electronic cigarette further comprises a battery component connected to the electronic cigarette atomizing device, and the battery component comprises batteries, control panels, pneumatic switches and indication lights.

13. An electronic cigarette, wherein the electronic cigarette adopts the electronic cigarette atomizing device as claimed in claim 1, the electronic cigarette further comprises a battery component connected to the electronic cigarette atomizing device, and the battery component comprises batteries, control panels, pneumatic switches and indication lights.

14. An electronic cigarette, wherein the electronic cigarette adopts the electronic cigarette atomizing device as claimed in claim 5, the electronic cigarette further comprises a battery component connected to the electronic cigarette atomizing device, and the battery component comprises batteries, control panels, pneumatic switches and indication lights.

15. An electronic cigarette, wherein the electronic cigarette adopts the electronic cigarette atomizing device as claimed in claim 6, the electronic cigarette further comprises a battery component connected to the electronic cigarette atomizing device, and the battery component comprises batteries, control panels, pneumatic switches and indication lights.

16. An electronic cigarette, wherein the electronic cigarette adopts the electronic cigarette atomizing device as claimed in claim 7, the electronic cigarette further comprises a battery component connected to the electronic cigarette atomizing device, and the battery component comprises batteries, control panels, pneumatic switches and indication lights.

17. An electronic cigarette atomizing device, comprising an atomizing component installed within an outer tube of the atomizing device and used for heating and atomizing tobacco liquid, and a liquid cup used for accommodating tobacco liquid, wherein the atomizing component comprises an atomizing holder and a heating component fixed inside the atomizing holder, a filter component is installed for filtering tobacco liquid in order to enter an inside of the atomizing holder and is disposed between the liquid cup and the atomizing holder, the other end of the atomizing holder is connected in turn to an engaging insert and a thread thimble, the filter component comprises a filter net with micropores and a filter cotton, the filter cotton is attached to a bottom of the filter net, two air passages are formed and disposed between the liquid cup and the outer tube, and the air passages are communicated with the atomizing component;

wherein a concave first groove is disposed and installed at each of both sides of the liquid cup, and at least one of the air passages is formed by one of the first grooves and an inner wall of the outer tube.

18. An electronic cigarette atomizing device, comprising an atomizing component installed within an outer tube of the atomizing device and used for heating and atomizing tobacco liquid, and a liquid cup used for accommodating tobacco liquid, wherein the atomizing component comprises an atomizing holder and a heating component fixed inside the atomizing holder, a filter component is installed for filtering tobacco liquid in order to enter an inside of the atomizing holder and is disposed between the liquid cup and the atomizing holder, the other end of the atomizing holder is connected in turn to an engaging insert and a thread thimble, the filter component comprises a filter net with micropores and a filter cotton, the filter cotton is attached to a bottom of the filter net, two air passages are formed and disposed between the liquid cup and the outer tube, and the air passages are communicated with the atomizing component;

wherein a metal sleeve is installed and disposed between the atomizing holder and the outer tube, a lower end of the metal sleeve completely surrounds the atomizing holder, and an upper end of the metal sleeve surrounds a lower end portion of the liquid cup.

19. An electronic cigarette atomizing device, comprising an atomizing component installed within an outer tube of the atomizing device and used for heating and atomizing tobacco liquid, and a liquid cup used for accommodating tobacco liquid, wherein the atomizing component comprises an atomizing holder and a heating component fixed inside the atomizing holder, a filter component is installed for filtering tobacco liquid in order to enter an inside of the atomizing holder and is disposed between the liquid cup and the atomizing holder, the other end of the atomizing holder is connected in turn to an engaging insert and a thread thimble, the filter component comprises a filter net with micropores and a filter cotton, the filter cotton is attached to a bottom of the filter net, two air passages are formed and disposed between the liquid cup and the outer tube, and the air passages are communicated with the atomizing component;

wherein the outer tube is a plastic outer tube.

* * * * *